US009487914B1

(12) United States Patent
Powars

(10) Patent No.: US 9,487,914 B1
(45) Date of Patent: Nov. 8, 2016

(54) DECORTICATION METHODS FOR PRODUCING RAW MATERIALS FROM PLANT BIOMASS

(71) Applicant: 9F, Inc., Denver, CO (US)

(72) Inventor: Adam Powars, Denver, CO (US)

(73) Assignee: 9F, Inc., Denver, CO (US)

( * ) Notice: Subject to any disclaimer, the term of this patent is extended or adjusted under 35 U.S.C. 154(b) by 0 days.

(21) Appl. No.: 14/826,093

(22) Filed: Aug. 13, 2015

(51) Int. Cl.

| | |
|---|---|
| ***D01C 1/00*** | (2006.01) |
| ***D01C 1/02*** | (2006.01) |
| ***D21C 1/08*** | (2006.01) |
| ***D21B 1/02*** | (2006.01) |
| *D21C 1/02* | (2006.01) |

(52) U.S. Cl.
CPC . *D21C 1/08* (2013.01); *D01C 1/00* (2013.01); *D01C 1/02* (2013.01); *D21B 1/021* (2013.01); *D21C 1/02* (2013.01)

(58) Field of Classification Search
CPC ..... D01C 1/00; D01C 1/02; D01C 1/08; D21B 1/021; D21B 1/026
See application file for complete search history.

(56) References Cited

U.S. PATENT DOCUMENTS

| | | | | |
|---|---|---|---|---|
| 2,468,771 | A | 5/1949 | Montonna et al. | |
| 2,978,446 | A | 4/1961 | Battista et al. | |
| 4,851,082 | A * | 7/1989 | Mita | D21C 3/222 162/76 |
| 5,494,748 | A | 2/1996 | Spehner | |
| 7,669,292 | B2 | 3/2010 | Chute et al. | |
| 2007/0125507 | A1* | 6/2007 | Walter | D21B 1/16 162/24 |
| 2008/0289783 | A1 | 11/2008 | Luo et al. | |
| 2010/0233481 | A1 | 9/2010 | Isogai et al. | |
| 2014/0200335 | A1 | 7/2014 | Olkowski et al. | |
| 2016/0130762 | A1* | 5/2016 | Ramaratnam | D21H 7/30 162/129 |

FOREIGN PATENT DOCUMENTS

| | | | |
|---|---|---|---|
| SU | 927864 | A1 * | 5/1982 |
| WO | 2007037711 | A1 | 4/2007 |

OTHER PUBLICATIONS

Baley Anne, Iron for Plants:Why Do Plants Need Iron?, downloaded online 2016, downloaded from www.gardeningknowhow.com.*

HydrogenLink Inc. "Cellulose and Bast Fibers Upgrading". <http://www.hydrogenlink.com/cellulosefiber>. 9 pages Printed Aug. 13, 2015.

HydrogenLink Inc. "Overview". <http://www.hydrogenlink.com/cellulosefiber>. 5 pages. Printed Aug. 13, 2015.

(Continued)

*Primary Examiner* — Anthony Calandra
(74) *Attorney, Agent, or Firm* — Faegre Baker Daniels LLP

(57) ABSTRACT

Embodiments of the present disclosure generally relate to materials and methods for producing a wide range of raw materials from plant biomass. In certain embodiments, the present disclosure provides materials and methods for efficient decortication of plant biomass using a thermally regulated process to generate reactive oxygen species in the presence of a catalyst. Embodiments of the present disclosure address the need for improved methods with which to obtain a wide range of raw materials from plant biomass without the need for industrial decortication machines and without producing harmful industrial waste.

19 Claims, 4 Drawing Sheets

(56) References Cited

OTHER PUBLICATIONS

Nano-Green. Blue Goose Biorefineries Nanocellulose Production. <http://nano-greenbiorefineries.com/> 2 pages. Printed Aug. 13, 2015.

Chen, H. "Chapter 6: Applications of Gas Explosion in Biomass Refining." in: Gas Explosion Technology and Biomass Refinery (Springer, 2015), pp. 227-364.

* cited by examiner

DECORTICATION METHODS FOR PRODUCING RAW MATERIALS FROM PLANT BIOMASS

FIELD

Embodiments of the present disclosure generally relate to materials and methods for producing a wide range of raw materials from plant biomass. In certain embodiments, the present disclosure provides materials and methods for efficient decortication of plant biomass using a thermally regulated process to generate reactive oxygen species in the presence of a catalyst.

BACKGROUND

Biomass is generally considered any material derived from living organisms. Plant-based biomass, which includes plants and plant-based material that is not typically used for food or feed (e.g., lignocellulosic biomass), has become a valuable resource for energy production and raw materials. In particular, the fibers of many plants, including fibers from the leaves, seeds, fruit, grass, and stems of plants can be used for a wide range of different industrial purposes. For example, bast fiber is a specific type of fiber that resides between the outer epidermis of a plant's stem and its inner core, also referred to as xylem or hurd. The most common cultivated bast crops in North America are flax and hemp, which were historically used to make linen and rope.

More recently, bast fibers extracted from various plants have been used in textiles, clothing, paper, composite fabrication, and in many other modern industrial contexts. However, despite their potential utility, the ability of bast fibers to play a larger role in these industries has been hampered by the generally limited supply of bast fibers. Often times, plants that can be used to produce bast fibers are instead cultivated for seed production and oil extraction, and are not optimized for fiber production. Additionally, extracting fibers from bast plants and the subsequent treatment required to produce, for example, yarn for clothing or composite material for buildings is an expensive and labor-intensive process, typically involving cutting the stalks, followed by retting, decorticating, and/or degumming the stalks. Therefore, there is a need for improved methods for obtaining a wide range of raw materials from plant biomass, and in particular plant fibers, that are less costly, more efficient, less labor intensive, and/or sufficiently versatile to take advantage of existing supplies of plant biomass, regardless of its form or source.

SUMMARY

Embodiments of the present disclosure include a method for decorticating plant biomass material. In accordance with these embodiments, the method includes submerging the plant biomass material in an aqueous-based decortication solution so that the submerged plant biomass material is adjacent to one or more catalysts. The method also includes heating the decortication solution containing the submerged plant biomass material to between about 85-98° C. for a pre-determined incubation period. The method further includes introducing reactive oxygen species (ROS) into the decortication solution adjacent to the one or more catalysts during the incubation period, so that the one or more catalysts interact chemically with the ROS to decorticate the plant biomass material.

In some embodiments, the method involves the use of plant biomass material from the *Cannabis* genus. In some embodiments, the method involves the use of a catalyst that is comprised of one or more transition metals that facilitates a transfer of electrons to produce the ROS. In some embodiments, the ROS is one or more of a peroxide, hydrogen peroxide, nitric oxide, an oxygen ion, a hydroxyl ion, a hydroxyl radical, and superoxide. In other embodiments, the one or more catalysts is an iron-based catalyst, the ROS is hydrogen peroxide, and the iron-based catalyst interacts chemically with the hydrogen peroxide to produce hydroxyl radicals that decorticate the plant biomass material. In some embodiments, the iron-based catalyst is present in an amount between about 2.0 and about 6.0 grams per liter of the decortication solution. In some embodiments, the hydrogen peroxide is introduced as a 35% hydrogen peroxide solution into the decortication solution in amounts between about 0.2% and about 0.06% of the total volume of the decortication solution.

Embodiments of the method also include introducing ROS into the decortication solution at 10 minute intervals during a 1 hour incubation period, adding an alkaline-based mixture to the decortication solution to terminate the chemical interaction between the one or more catalysts and the ROS, and separating the fibers from the hurd of the plant biomass material upon termination of the chemical reaction. In some embodiments, the method further involves repeating the submerging, heating, and introducing steps of the method using the fibers separated from the hurd of the plant biomass material until fibers having the desired degree of thickness and coarseness are obtained.

Embodiments of the present disclosure also include a system for decorticating plant biomass. In accordance with these embodiments, the system includes a decortication assembly comprising a screen formed of an inorganic material, an anchoring mechanism, and at least one catalyst containment unit having a plurality of individual cells each containing one or more catalysts. In some embodiments, the decortication assembly is configured to secure the plant biomass adjacent the catalyst containment unit so as to effect decortication of the plant biomass in the presence of heat and a ROS. Embodiments of the system also include a decortication vessel that includes a first opening configured to receive the decortication assembly and a second opening configured to form an inlet for introducing the ROS into the decortication vessel. In accordance with embodiments of the system, subjecting the plant biomass material to a combination of heat and ROS in the presence of the one or more catalysts decorticates the plant biomass.

In some embodiments, the system involves the use plant biomass material from the *Cannabis* genus. In some embodiments of the system, the one or more catalysts is an iron-based catalyst, the ROS is hydrogen peroxide, and the iron-based catalyst interacts chemically with the hydrogen peroxide to produce hydroxyl radicals that decorticate the plant biomass material. In some embodiments of the system, the inlet for introducing ROS into the decortication vessel is positioned in the decortication vessel such that the ROS is introduced adjacent to the one or more catalysts contained within the individual cells of the catalyst containment unit. In other embodiments of the system, the anchoring mechanism comprises a stainless steel metal screen and at least one clamp to facilitate the complete submersion of the decortication assembly in decortication solution when the system is in use.

Embodiments of the present disclosure also include a plant biomass catalyst containment unit a plurality of individual cells containing one or more catalysts. In accordance with these embodiments, both the catalyst containment unit and the cells containing the one or more catalysts are comprised of porous material to allow for chemical interaction between the one or more catalysts and the ROS. In some embodiments, the porous material comprising the cells is separate from the porous material comprising the catalyst containment unit. In other embodiments, the cells containing the one or more catalysts are detachable to allow for the replacement of a portion of the one or more catalysts catalyst from the catalyst containment unit.

As used herein, the terms "plant biomass" and "plant biomass material" generally refer to biomass obtained from any plant-based material, including single-celled organisms as well as asexually and sexually reproducing plants. In accordance with some embodiments of the present disclosure, plant biomass includes bast fibers from the outer bark of plants such as jute, kenaf, flax, and *Cannabis* plants, including hemp and marijuana plants.

As used herein, the terms "decortication," "decorticate," "decorticates," "decorticating," and "decorticated" generally refer to processes for removing the outer layers of tissue from a plant or plant biomass to expose underlying fibers. Decortication as used herein includes, but is not limited to, biological, chemical and mechanical treatment processes, and combinations thereof.

The terms "determine," "calculate," and "compute," and variations thereof, as used herein, are used interchangeably and include any type of methodology, process, mathematical operation or technique.

It is to be noted that the term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The various characteristics mentioned above, as well as other features and characteristics described in more detail herein will be readily apparent to those skilled in the art with the aid of the present disclosure upon reading the following detailed description of the embodiments.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "means" as used herein shall be given its broadest possible interpretation in accordance with 35 U.S.C. §112(f). Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Embodiments of the present disclosure generally relate to materials and methods for producing a wide range of raw materials from plant biomass. In certain embodiments, the present disclosure provides materials and methods for efficient decortication of plant biomass using a thermally regulated process to generate reactive oxygen species in the presence of a catalyst.

Figure 1:
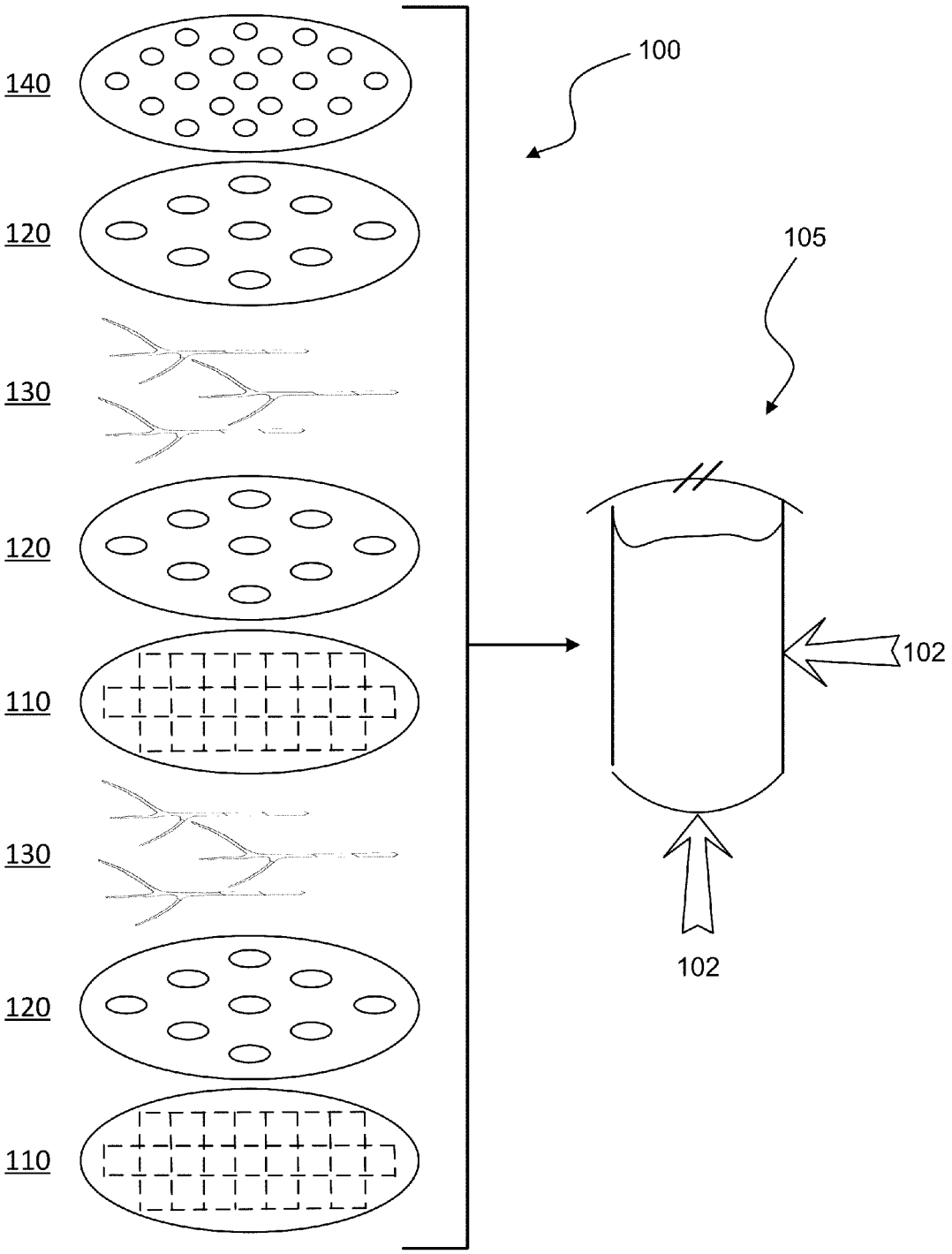
FIG. 1 is a representative diagram of a decortication assembly containing plant biomass contained within a decortication vessel, according to embodiments of the present disclosure.

As illustrated in FIG. 1, embodiments of the present disclosure include the use of a decortication assembly 100 contained within a decortication vessel 105. The decortication assembly 100 generally includes a plurality of layers having various components designed to facilitate the efficient decortication of plant-based biomass material. For example, the decortication methods and systems of the present disclosure can be used for the production of bast fibers having varying degrees of thickness and coarseness that can be used as raw materials in various industrial processes, such as clothing and textile production, without the need for industrial equipment and without producing harmful industrial waste.

In one embodiment, the decortication assembly 100 comprises two groups of layers, with each layer further comprising a catalyst containment unit 110, a porous material 120, and plant biomass material 130. In some cases, the porous material is a porous plastic screen 120. As illustrated in FIG. 1, each group of layers can be stacked and placed in the decortication vessel 105 and held in place with an anchoring material 140. In some cases, the anchoring material is a metal screen 140. In other cases, the anchoring material is part of an anchoring mechanism that includes a metal screen and/or a separate clamping device. In either case, the anchoring material or anchoring mechanism is designed to keep the layers in their respective positions and to maintain complete submersion of the layers in the decortication solution. Additionally, the individual components of the decortication assembly 100 are generally shaped to occupy the width and length of the decortication vessel 105 (e.g., generally circular components of the decortication assembly in a generally circular decortication vessel). The decortication process, or decortication treatment, takes place in an aqueous-based decortication solution, as described further below.

Figure 2A:
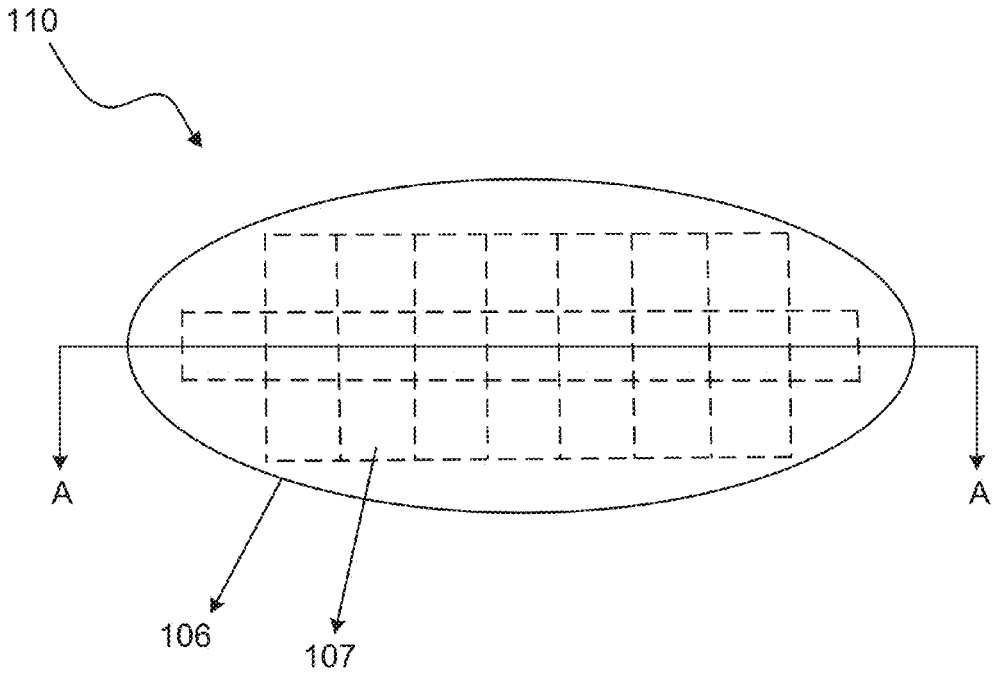
FIG. 2A is a representative diagram of a top view of a catalyst containment unit, according to embodiments of the present disclosure.
Figure 2B:
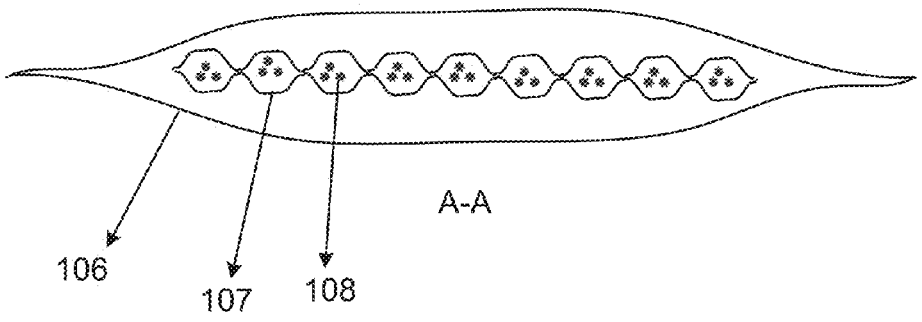
FIG. 2B is a representative diagram of a cross-sectional view of the catalyst containment unit of FIG. 2A, cut along the lines A-A in FIG. 2A.

In some embodiments, the catalyst containment unit 110 used in the decortication assembly 100 is comprised of a porous material to allow for the flow of decortication solution freely into and out of the porous material. As illustrated in FIGS. 2A-2B, the catalyst containment unit 110 can be configured to have an outer layer 106 of porous material that encloses at least one and up to a plurality of cells 107 that contain one or more catalysts 108. This modular configuration allows for the replacement of a portion of the catalyst 108 without the need to replace the entire catalyst containment unit 110, and allows for placing the catalyst 108 in different positions within the unit 110 (e.g., at the center or the periphery of the unit). Because the catalyst in the catalyst 108 containment unit 110 can be used for multiple decortication treatments, the ability to remove only the individual cells 107 having catalyst that is no longer chemically active reduces the overall cost of the decortication process.

The porous material that comprises the catalyst containment unit 100 and the individual cells 107 containing the catalyst 108 can include any material that is suitable for use in aqueous environments, including but not limited to, various plastics and polymers materials, such as polystyrene (PS), polycarbonate (PC), acrylonitrile-butadiene-styrene (ABS), polybutylene terephthalate (PBTP), styrene acrylonitrile (SAN), polyamide (PA), polyoxymethylene (POM), polyphenylene oxide (PPO), PE, PP, PTFE and homopolymers and copolymers of these plastics. The plastics may also be used in a filled or fiber-reinforced form, and/or coupled to portions of metals or metal alloys, such as aluminum, titanium, steel, and combinations thereof. The materials used to construct the catalyst containment unit 100 and the individual cells 107 containing the catalyst can be surface-coated, for example with paints, varnishes or lacquers. The use of color plastics, for example colored with pigments, is also possible. In some aspects, the catalyst containment unit 100 and the individual cells containing the catalyst can be coated with substances that help to prevent contamination from microorganisms, bacteria, fungi, and the like. Additionally, the individual cells 107 of the catalyst containment unit 100 can be demarcated from each other and from the outer layer 106 using, for example, stitching or thread. In some cases, the stitching or tread used to demarcate the individual cells 107 and to contain the catalyst 108 is made of relatively thin inorganic fibers, such as nylon, polyurethane or a similar type of polymeric or plastic thread. In this manner, the cells 107 do not require heat sealing to create a suitable barrier and contain the catalyst 108.

The sizes and/or dimensions of the individual pores in the material used to construct the outer layer 106 of the catalyst containment unit 100 and the individual cells 107 containing the catalyst can vary, as would be apparent to one of ordinary skill in the art based on the present disclosure. However, the pores may not be so large as to allow for the catalyst 108 to exit the cells 107 or the outer layer 106 during the decortication process, and the pores may not be so small as to hinder the flow of decortication solution or any chemical components in the decortication solution (e.g., reactive oxygen species) during the decortication process.

The order in which the individual components of the decortication assembly 100 are stacked within the decortication vessel 105 can vary. For example, as shown in FIG. 1, the catalyst containment unit 110 can occupy the lowest layer of the assembly and can be separated from the plant biomass material 130 with a porous plastic screen 120. This order can be repeated, as shown in FIG. 1, for as many stacked layers as would be suitable for a given amount of biomass and/or a given decortication vessel. Generally, the porous plastic screen 120 is sufficiently thin and porous so as not to hinder the ability of the catalyst to facilitate the chemical interaction between the decortication solution or any components in the decortication solution (e.g., reactive oxygen species) and the plant biomass material 130. Thus, the catalyst containment unit 110 generally occupies a position that is adjacent to the plant biomass material 130, as shown in FIG. 1. Although other materials may lie between the catalyst containment unit 110 and the plant biomass material 130 (e.g., a plastic screen and/or porous material), being adjacent generally refers to the catalyst being close enough to the plant material such that the chemical reaction taking place with the ROS is not hindered by too much space or material between the catalyst containment unit 110 and the plant biomass material 130.

The decortication process, or decortication treatment, takes place in an aqueous-based decortication solution, and the decortication solution of the present disclosure is typically an aqueous-based solution, and in some cases, is comprised of only water. The volume of decortication solution used during decortication treatment varies, depending on, for example, the size of the decortication vessel 105. Typically, the amount of decortication solution will be sufficient to completely submerge the decortication assembly 100 containing the plant biomass material 130 and the catalyst containment unit 110 in decortication solution (often with the aid of an anchoring mechanism). Additionally, as described further below, the decortication process involves the application of heat to the decortication vessel 105 in order to augment the chemical interactions taking place in it. Due to the fact that the decortication process is aqueous-based and heat is applied, the decortication vessel 110 is typically constructed of material suitable for such treatment, including but not limited to, stainless steel, galvanized stainless steel, and the like. In some embodiments, a lid is used to enclose the decortication assembly 100 within the decortication vessel 105 during the decortication process. The lid can be configured to fully enclose the opening of the decortication vessel 105 in a manner that is pressure-sealed, or the lid can passively rest atop the decortication vessel 105. In some cases, the lid is contains vents or openings to expel gaseous products produced during decortication treatment.

The overall configuration of the decortication assembly 100 and the decortication vessel 105 of the present disclosure is designed to facilitate the decortication of plant-based biomass material using a catalytic reaction that produces reactive oxygen species (ROS). This reaction is often referred to as advanced oxidation processes or catalytic advanced oxidation, and it can be used to breakdown complex structures and macromolecules into their constituent parts using ROS generated from a chemical compound interacting with a catalyst. For example, the decortication process of the present disclosure can generate ROS to facilitate the breakdown of bast plant fibers into fibers having varying degrees of texture and coarseness.

Generally, the phrase "reactive oxygen species" is used to describe a number of reactive molecules and free radicals derived from molecular oxygen. Their reactivity is generally due to their presence of an unpaired electron, which has potent degradation effects on a wide variety of substances. This degradation effect can often be measured in terms of a chemical's oxidation potential (e.g., the oxidative capacity of a given oxidizing agent). Molecular oxygen can be used to generate a number of ROS, including but not limited to, peroxide, hydrogen peroxide, nitric oxide, an oxygen ion, a hydroxyl ion, a hydroxyl radical, and superoxide, as shown below.

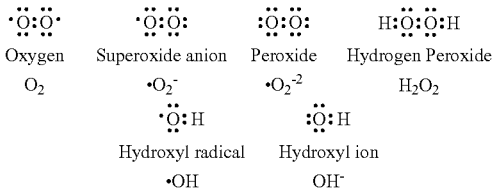

In some cases, the presence of a catalyst can augment the production of various ROS by shifting the dynamic equilibrium of a ROS reaction to the production of free radicals that can degrade various biomass materials. For example, in one embodiment of the present disclosure, hydrogen peroxide can be used to generate hydroxyl radicals in the presence of a transition metal catalyst, as illustrated in Equation 1 (below).

$$H_2O_2+Fe^{2+}\rightarrow .OH+OH^-+Fe^{3+} \quad \text{(eq. 1)}$$

Without being limited to a particular catalyst, embodiments of the present disclosure can include catalysts that are comprised of one or more transition metals, such as but not limited to, Scandium, Titanium, Vanadium, Chromium, Manganese, Iron, Cobalt, Nickel, Copper, Zinc, Yttrium, Zirconium, Niobium, Molybdenum, Technetium, Ruthenium, Rhodium, Palladium, Silver, Cadmium, Hafnium, Tantalum, Tungsten, Rhenium, Osmium, Iridium, Platinum, Gold, Mercury, Rutherfordium, Dubnium, Seaborgium, Bohrium, Hassium, Meitnerium, Ununnilium, Unununium, and Ununbium. Additionally, as would be readily recognized by one of ordinary skill in the art based on the present disclosure, catalysts of the present disclosure can be any heterogeneous mixture and/or combination of the above transitional metals, and may include other components that augment the catalytic process and the production of ROS. In some embodiments of the present disclosure, the catalyst is an iron-based catalyst and the iron-based catalyst interacts chemically with hydrogen peroxide in an aqueous solution to produce hydroxyl radicals that breakdown plant biomass material into its constituent fibers during a decortication process. In other embodiments, the catalyst is a heterogeneous catalyst obtained from HydrogenLink Inc.

As described above, embodiments of the decortication processes and methods of the present disclosure involve the introduction of ROS into the decortication solution via one or more in inlets 102 (FIG. 1), such that the ROS is delivered adjacent to the catalyst contained in the catalyst containment unit 110. The inlets 102 can be located in various positions in the decortication vessel 105, including at the bottom portion of the vessel and/or the side portions of the vessel (e.g., if there are several stacked layers of the decortication assembly 100). In some embodiments, hydrogen peroxide is the ROS, and it is introduced into the decortication solution via an inlet 102 at the bottom portion of the decortication vessel 100, adjacent to an iron-based catalyst contained in the catalyst containment unit 110. In some embodiments, the decortication systems of the present disclosure include two or more decortication vessels 105 functionally coupled into a larger overall system. For example, two or more decortication vessels 105 can be functionally coupled in series or in parallel, and decortication solution can be configured to flow between and/or among the individual decortication vessels 105 in the decortication system. The decortication vessels 105 can be functionally coupled by various means, such as pipes, enclosed channels and/or conduits. Additionally, individual decortication vessels in a given decortication system can be functionally and/or electrically synced with each other, such that, for example, ROS can be injected simultaneously, and/or plant biomass can be washed and removed simultaneously during the decortication process. These and similar configurations can be included in embodiments of the decortication systems of the present disclosure as part of scaling up the decortication process, as would be readily recognized by one or ordinary skill in the art based on the present disclosure.

Plant biomass material that can be decorticated with the decortication methods and systems of the present disclosure include any biomass obtained from any plant-based material, including single-celled organisms as well as asexually and sexually reproducing plants. In accordance with some embodiments of the present disclosure, plant biomass includes bast fibers from the outer bark of plants such as jute, kenaf, flax, and *Cannabis* plants, including hemp and marijuana plants. In some embodiments, the plant biomass material is marijuana stalks or stems that have been discarded after being used for the treatment of various diseases (e.g., medical marijuana), as well as other forms of marijuana biomass that have little or no detectable THC content. In some cases, the plant biomass material is *Cannabis indica, Cannabis sativa*, or *Cannabis ruderalis*, or a combination or hybrid thereof. In some cases, the methods as described herein facilitate the removal of any THC present in the plant-based biomass, such that there is little to no detectable THC present in the end products. In other cases, the methods as described herein facilitate the removal of all THC present in the plant-based biomass, such that there is no THC present in the end products. For example, one or more end products obtained using the methods of the present disclosure were tested for THC content (e.g., using CannLabs, 3888 E. Mexico Ave, Suite 238, Denver, Colo. 80210) and all were determined to have 0% THC present.

Figure 3:
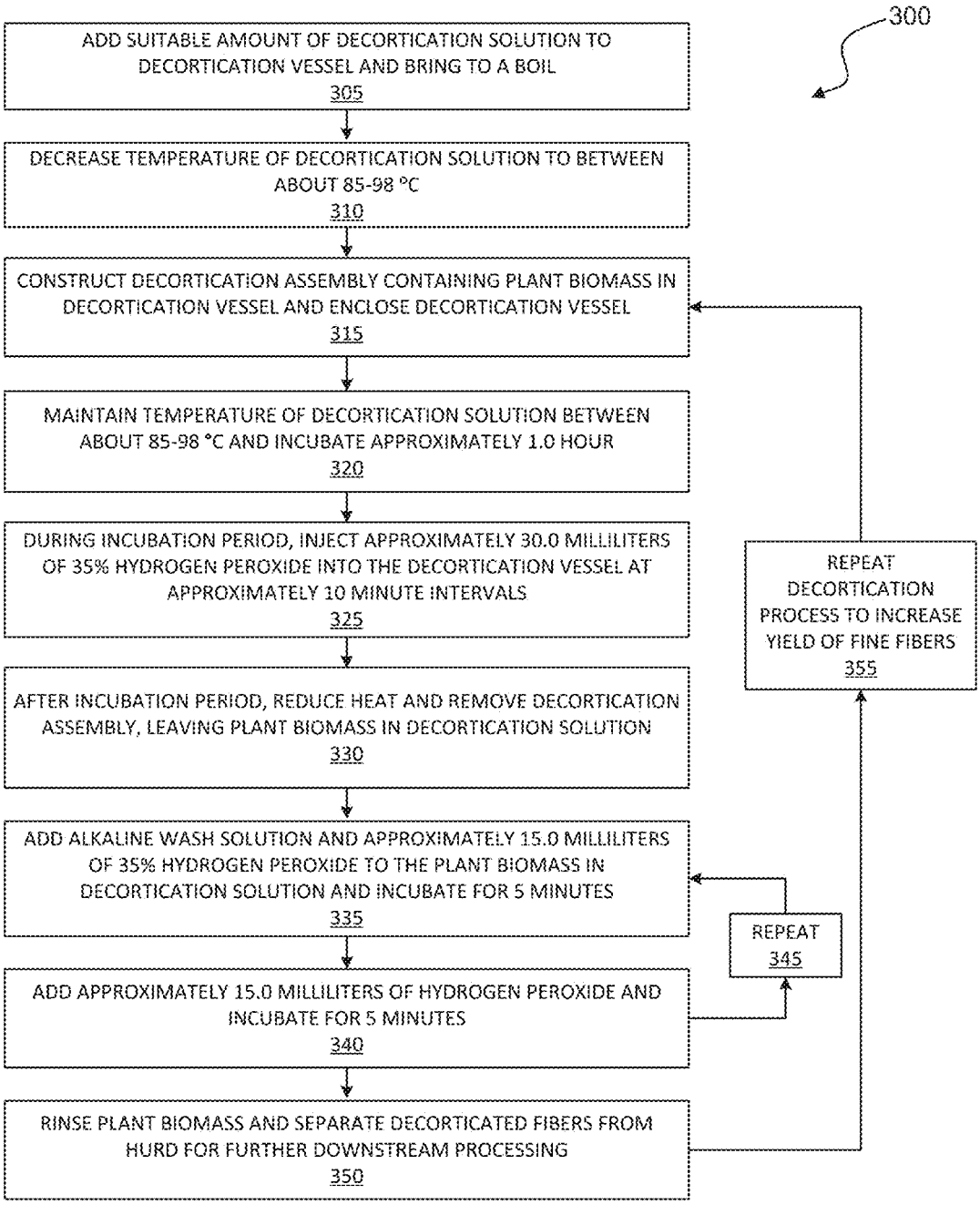
FIG. 3 is a representative flow diagram of a decortication process carried out using plant biomass, according to embodiments of the present disclosure.
Figure 4:
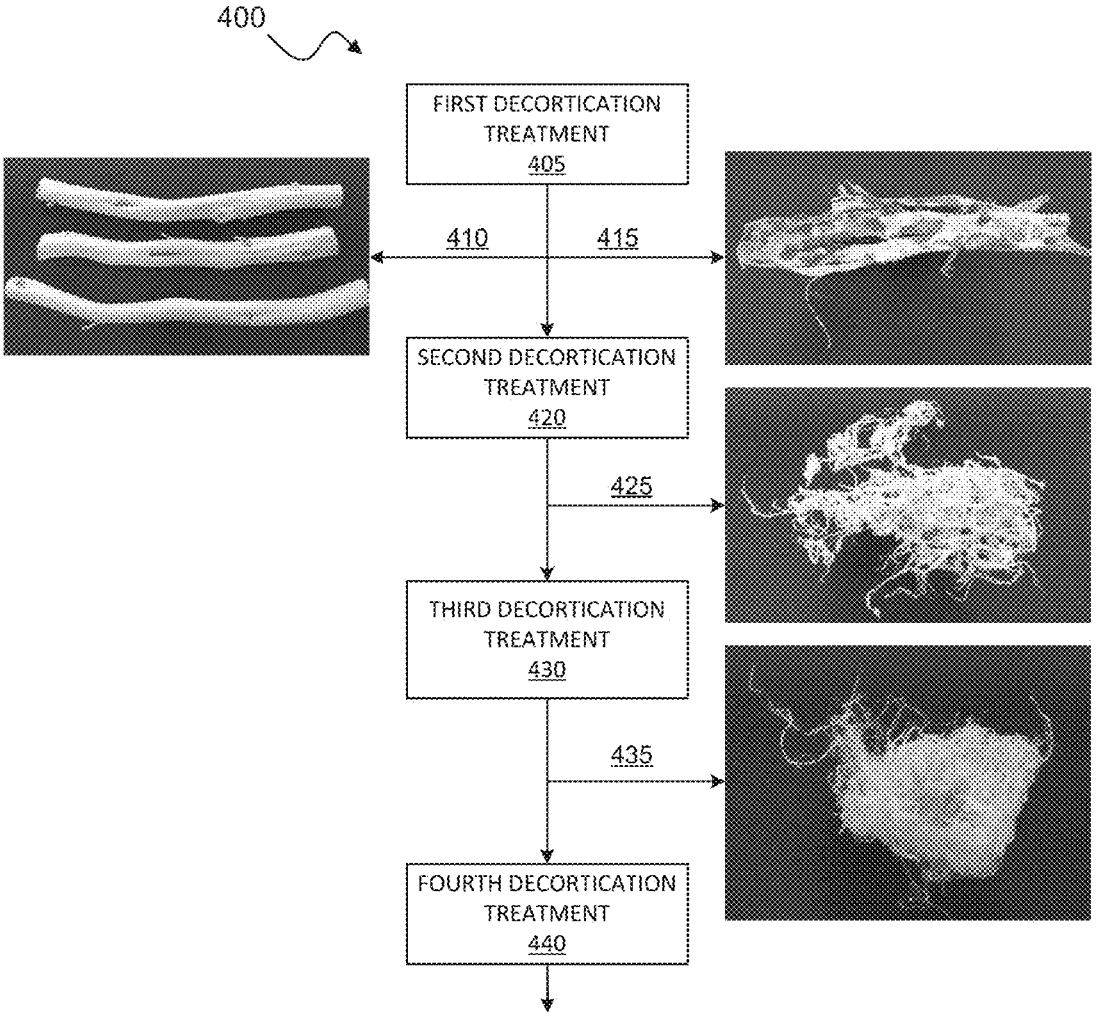
FIG. 4 is a representative flow diagram with corresponding images of fibers obtained from successive decortication treatments, according to embodiments of the present disclosure.

As illustrated in FIGS. 3 and 4, embodiments of the present disclosure include methods for decorticating plant-based biomass material. In one embodiment, method 300 includes adding a suitable amount of decortication solution to a decortication vessel and adding sufficient heat to bring the decortication solution to a boil (305). The temperature of the decortication solution can then be reduced to below boiling, for example, between approximately 85-98° C. (310). In some cases, the heat can be reduced so that the temperature of the decortication solution is approximately 90° C. for the duration of the decortication process. A decortication assembly comprising layers of plant biomass material, plastic and metal screens, and catalyst containment units can then be constructed and enclosed within a decortication vessel (315). The temperature of the decortication solution can then be maintained between about 85-98° C. for an incubation period of approximately 1.0 hour (320). Other incubation time periods are also contemplated, the use of which will depend on a variety of factors, including for example, the desired degree of thickness and/or coarseness of the fibers produced from the plant biomass material.

During the incubation period, one or more sources of ROS can be delivered or introduced into the decortication solution (see FIG. 1) in various volumes. For example, according to the embodiment of FIG. 3, approximately 30.0 milliliters of hydrogen peroxide can be introduced into the decortication solution to facilitate the breakdown of plant biomass material. The amount of ROS can vary, however, depending on a number of variables, including for example, the desired degree of thickness and/or coarseness of the fibers produced from the plant biomass material, and or the total volume of decortication solution. In some cases, the amount of ROS, such as a 35% solution of hydrogen peroxide, introduced into the decortication solution can be between about 0.2% and about 0.06% of the total volume of the decortication solution. In some cases, the amount of ROS introduced into the decortication solution can be between about 0.2% and about 0.04% of the total volume of the decortication solution. In some cases, the amount of ROS introduced into the decortication solution can be between about 0.4% and about 0.06% of the total volume of the decortication solution. The ROS can be introduced or delivered into the decortication solution in various intervals of time during the incubation period. For example, ROS can be introduced into the decortication solution in approximately 10 minute intervals (e.g., ROS introduced a total of six times in a 1.0 hour incubation period) (325). Both the length of the incubation period and the length of the intervals between deliveries of ROS can vary, and will ultimately depend on variables such as the desired degree of thickness and/or coarseness of the fibers produced from the plant biomass material, and or the total volume of decortication solution. In accordance with these embodiments, the introduction of ROS and the application of heat in the presence of a catalyst to the decortication solution, as described above, facilitates the breakdown of plant biomass material during the decortication process.

After the incubation period, the decortication assembly is cooled and disassembled, leaving the plant biomass material in the decortication solution (330). An alkaline wash solution or alkaline powder (e.g., 30 grams of sodium bicarbonate) can be added to the decortication solution with or without additional ROS (e.g., 15 milliliters of hydrogen peroxide), and incubated for approximately 5 minutes (335). Subsequently, additional ROS (e.g., 15 milliliters of hydrogen peroxide) can be introduced and incubated for an additional 5 minutes (340). In some cases, this alkaline wash process can be repeated (345). The alkaline wash step can enhance both the decortication treatment, as well as the process of degumming the plant biomass material by promoting cleaner separation of the fibers from the hurd. In some cases, the alkaline wash step can be performed twice at the end of a decortication treatment, and in other cases, the alkaline wash step can be performed more than twice and up to 10 times after a decortication treatment.

The plant biomass material can then be rinsed, for example, in cold water, and in some cases, the outer portions of the plant biomass material (e.g., bast fibers) can be removed from the stalks or hurd (350). The hurd, which is undamaged from the above-described decortication process, can be subjected to further downstream processing, and in some cases, the decortication treatment can be repeated using the fibers removed from the hurd after the first decortication treatment (355). The hurd can also be used as a raw material for the creation of bio-composite building materials (e.g., hemperete). Bio-composite building material made using hurd obtained from the methods of the present disclosure can be used to provide structural support to buildings and/or can be used as an insulating element.

Generally, subjecting the same fibers to multiple decortication treatments results in fibers having decreased thickness and coarseness (e.g., thinner and softer), as illustrated in method 400 of FIG. 4. For example, after a first decortication treatment (405), the hurd (410) can be separated from the outer tissue of the plant biomass or bast fibers (415). After a second decortication treatment (420), the fibers from the first decortication treatment are thinner and less coarse (425). After a second decortication treatment (430), the fibers from the second decortication treatment are even thinner and less coarse (435). This process can be repeated as many times as desired (440) or until fibers having the desired degree of coarseness and thickness are obtained. In some cases, the decortication process of FIG. 4 can be repeated until the end product is liquid cellulose, which can be separated from the decortication solution to obtain substantially purified liquid cellulose.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent.

Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

The present disclosure, in various aspects, embodiments, and configurations, includes components, methods, processes, systems and/or apparatus substantially as depicted and described herein, including various aspects, embodiments, configurations, sub combinations, and subsets thereof. Those of skill in the art will understand how to make and use the various aspects, aspects, embodiments, and configurations, after understanding the present disclosure. The present disclosure, in various aspects, embodiments, and configurations, includes providing compositions and processes in the absence of items not depicted and/or described herein or in various aspects, embodiments, and configurations hereof, including in the absence of such items as may have been used in previous compositions or processes, e.g., for improving performance, achieving ease and\or reducing cost of implementation.

EXAMPLES

Decortication of Plant Biomass from *Cannabis*

Decortication treatment of plant biomass, according to embodiments of the methods of the present disclosure, can be used to obtain fibers of varying degrees of texture and thickness, as well as for obtaining clean and undamaged hurd. In one embodiment, approximately 195.87 grams of marijuana stalks or stems labeled Biomass Group A and approximately 192.41 grams of marijuana stalks or stems labeled Biomass Group B were incorporated into a decortication assembly (see FIG. 1). The decortication assembly consisted of (from bottom to top): a first porous catalyst containment unit containing approximately 17.0 grams of catalyst (e.g., heterogeneous catalyst obtained from HydrogenLink Inc.) housed in individual cells within the catalyst containment unit; a first porous plastic screen; Biomass Group A; a second porous catalyst containment unit; a second porous plastic screen; Biomass Group B; a third porous plastic screen; and a stainless steel lid to compress and provide anchoring support to the decortication assembly. Prior to placement of the decortication assembly into a stainless steel decortication vessel, approximately 6.0 liters of an aqueous-based decortication solution was added to the vessel, such that Biomass Groups A and B would be fully submerged in the decortication solution when anchoring support is provided by the stainless steel lid of the decortication vessel (see FIG. 3). Sufficient heat then was applied to the decortication solution to bring it to a boil. Subsequently, the heat was reduced so that the temperature of the decortication solution was approximately 90° C.

The decortication assembly containing Biomass Groups A and B were then placed into the decortication vessel, which was approximately the same size and shape as the decortication assembly (e.g., generally circular), with Biomass Groups A and B being fully submerged in decortication solution. The decortication assembly containing Biomass Groups A and B was then incubated at approximately 90° C. for 1 hour. During this incubation period, approximately 30 milliliters of a 35% hydrogen peroxide solution was injected into the bottom portion of the decortication vessel, adjacent to the catalyst containment unit, approximately every 10 minutes (e.g., six total injections of hydrogen peroxide per hour). After the incubation period, approximately 30 grams of alkaline powder (e.g., sodium bicarbonate) and approximately 15 milliliters of hydrogen peroxide were added to the decortication solution and mixed. After an additional five minutes, approximately 15 milliliters of hydrogen peroxide was added to the decortication solution. After another five minute incubation period, an additional 30 grams of alkaline powder and 15 milliliters of hydrogen peroxide were added to the decortication solution and mixed, followed by another 15 milliliters of hydrogen peroxide after an additional five minute incubation period. The heat was then reduced and Biomass Groups A and B were rinsed with cold water. The fibers were then separated from the hurd (e.g., manually). The undamaged hurd (approximately 240 grams) was subject to further downstream processing. The separated fibers from Biomass Group A (approximately 154 grams) and the separated fibers from Biomass Group B (approximately 148 grams) were subjected to further decortication treatment to obtain fibers with decreased thickness and less coarse textures (see FIG. 4).

The decortication methods and systems of the present disclosure can be used to produce a wide range of different types of fibers, as well as undamaged hurd, which can be used as raw materials in various textile and manufacturing industries. As would be readily recognized by one of skill in the art based on the present disclosure, the above-described decortication processes obviate the need for extensive cutting or chopping up of the plant-based biomass prior to decortication. Typical decortication processes require the plant-based biomass to be chopped up or cut to small pieces suitable for grinding or to facilitate fiber separation. This process can lead to contamination as small particles from several portions of the plant become intermixed. Additionally, in many cases, the plant-based biomass is subsequently subjected to a degumming process. Degumming is generally considered to involve the removal of non-cellulosic gummy material from the cellulosic part of the plant fibers, a step that is typically necessary prior to the utilization of the fibers for textile production, for example. In contrast, the decortication methods and systems of the present disclosure can produce plant fibers without the need for excessive chopping up or grinding of the biomass and without a separate degumming process. Thus, the need for industrial machinery to perform the chopping and/or grinding (e.g., forage chopper, disc refiner, etc.), and any accompanying industrial waste produced therefrom, is eliminated using the method and systems of the present application. Additionally, the elimination of the need for excessive chopping and grinding produces intact hurd and greatly reduces the likelihood of hurd contamination in the plant fibers.

Additionally, because the methods and systems of the present application obviate the need to pre-treat, either chemically or mechanically, the source of plant biomass prior to being subject to decortication treatment, it is possible to use a wide range of sizes of plant-biomass material. For example, the methods of the present disclosure can be used with various different sizes of whole stems, stalks, or branches of a plant, as well as will pre-cut stems, stalks, or branches depending on the size and scale of the decortication vessel and decortication assembly. Although stems or branches may be cut and/or separated from other stem or branch portions on the plant prior to decortication treatment, the methods of the present disclosure do not require the stems or branches to be subsequently chopping to a predetermined length to be decorticated (e.g., 50-150 millimeters), or for example, to be compatible with certain industrial equipment.

According to some embodiments of the methods and systems of the present disclosure, the branches, stems or stalks of the plant biomass material can be cut to a generally uniform size, such as a generally uniform length, circumference or diameter, prior to decortication treatment. In some cases, branches, stems or stalks having smaller diameters require less time for decortication treatment (e.g., require shorter incubation periods), depending on the end product desired. The sizes of the branches, stems or stalks can be from greater than about 15 centimeters in length up to about 4 meters or greater in length, depending on the particular species and the decortication equipment being used.

The above examples, embodiments, definitions and explanations should not be taken as limiting the full metes and bounds of the invention. The present disclosure, in various aspects, embodiments, and configurations, includes components, methods, processes, systems and/or apparatus substantially as depicted and described herein, including various aspects, embodiments, configurations, sub combinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes (e.g., for improving performance, achieving ease and\or reducing cost of implementation).

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed:

1. A method for decorticating plant biomass material, the method comprising:

submerging the plant biomass material in an aqueous-based decortication solution, the submerged plant biomass material being located adjacent to one or more exogenous catalysts;

heating the decortication solution containing the submerged plant biomass material to between about 85-98° C. for a pre-determined incubation period; and introducing reactive oxygen species (ROS) into the decortication solution adjacent to the one or more exogenous catalysts during the incubation period at a plurality of pre-determined intervals so that the one or more exogenous catalysts interact chemically with the ROS to decorticate the plant biomass material.

2. The method of claim 1, wherein the plant biomass material is from the *Cannabis* genus.

3. The method of claim 1, wherein the one or more exogenous catalysts is comprised of one or more transition metals.

4. The method of claim 1, wherein the one or more exogenous catalysts facilitates a transfer of electrons to produce the ROS.

5. The method of claim 1, wherein the ROS is one or more of a peroxide, hydrogen peroxide, nitric oxide, an oxygen ion, a hydroxyl ion, a hydroxyl radical, and a superoxide.

6. The method of claim 1, wherein the one or more exogenous catalysts is an iron-based catalyst and the ROS is hydrogen peroxide, and wherein the iron-based catalyst interacts chemically with the hydrogen peroxide to produce hydroxyl radicals that decorticate the plant biomass material.

7. The method of claim 6, wherein the iron-based catalyst is present in an amount between about 2.0 and about 6.0 grams per liter of the decortication solution.

8. The method of claim 6, wherein the hydrogen peroxide is introduced as a 35% hydrogen peroxide solution into the decortication solution in amounts between about 0.2% and about 0.06% of the total volume of the decortication solution.

9. The method of claim 1, wherein the plurality of pre-determined intervals are 10 minutes in duration and wherein the incubation period is 1 hour.

10. The method of claim 1, wherein the method further comprises adding an alkaline-based mixture to the decortication solution to terminate the chemical interaction between the one or more exogenous catalyst and the ROS.

11. The method of claim 1, wherein decorticating the plant biomass material further comprises separating fibers from hurd of the plant biomass material.

12. The method of claim 11, wherein the method further comprises repeating the submerging, heating, and introducing steps of the method using the fibers separated from the hurd of the plant biomass material until fibers having a pre-determined degree of thickness and coarseness are obtained.

13. The method of claim 1, wherein the method is performed using a decortication assembly comprising:

a screen formed of inorganic material, an anchoring mechanism, and at least one catalyst containment unit having a plurality of individual cells, each containing the one or more exogenous catalysts, wherein the decortication assembly is configured to secure the plant biomass adjacent the catalyst containment unit; and a decortication vessel including a first opening configured to receive the decortication assembly and a second opening configured to form an inlet for introducing the ROS into the decortication vessel.

14. The method of claim 13, wherein the inlet for introducing the ROS into the decortication vessel is configured to introduce the ROS adjacent to the one or more exogenous catalysts contained within the individual cells of the catalyst containment unit.

15. The method of claim 13, wherein the anchoring mechanism comprises a stainless steel metal screen and at least one clamp to facilitate the complete submersion of the decortication assembly in a decortication solution.

16. The method of claim 1, wherein the method is performed using a plant biomass catalyst containment unit comprising a plurality of individual cells containing the one or more exogenous catalysts, wherein both the catalyst containment unit and the cells containing the one or more exogenous catalysts are comprised of porous material to allow for chemical interaction between the one or more exogenous catalysts and the ROS.

17. The method of claim 16, wherein the porous material comprising the cells is separate from the porous material comprising the catalyst containment unit.

18. The method of claim 16, wherein the cells containing the one or more exogenous catalysts are detachable from the catalyst containment unit to enable the replacement of at least a portion of the one or more exogenous catalysts.

19. The method of claim 1, wherein the biomass material is not subject to mechanical pre-treatment.

* * * * *